United States Patent [19]

Howard et al.

[11] 4,253,317

[45] Mar. 3, 1981

[54] SOCK CONSTRUCTION

[75] Inventors: Joseph W. Howard, Rockwood, Tenn.; Wayne L. Duggins, Asheboro, N.C.

[73] Assignee: Burlington Industries, Inc., Greensboro, N.C.

[21] Appl. No.: 33,713

[22] Filed: Apr. 26, 1979

[51] Int. Cl.[3] ..... A41B 11/02; D04B 9/46

[52] U.S. Cl. ..... 66/186; 2/239; 66/172 E

[58] Field of Search ..... 66/182, 185, 186, 187, 66/188, 194, 180, 190, 191; 2/239

[56] References Cited

U.S. PATENT DOCUMENTS

| | | | |
|---|---|---|---|
| 1,906,137 | 4/1933 | Davis | 2/240 |
| 2,102,368 | 12/1937 | Martel | 66/182 |
| 2,133,840 | 10/1938 | Anderson | 66/194 |
| 2,144,563 | 1/1939 | Davis | 66/182 |
| 2,183,862 | 12/1939 | Davis | 66/172 E |
| 2,219,235 | 10/1940 | Morton | 2/239 |
| 2,230,402 | 2/1941 | Getaz | 66/172 E |
| 2,318,643 | 5/1943 | Thurston | 66/173 |
| 2,473,677 | 6/1949 | Crawford et al. | 66/190 X |
| 3,154,933 | 11/1964 | Holder | 66/172 E |
| 3,166,992 | 1/1965 | York et al. | 66/172 E |
| 3,250,095 | 5/1966 | Bird | 66/185 |
| 3,793,851 | 2/1974 | Thorneberg | 66/185 |
| 3,990,115 | 11/1976 | Nester | 2/239 |
| 4,102,492 | 8/1979 | Roberts | 66/172 E |
| 4,172,370 | 10/1979 | Safrit | 66/178 R |
| 4,194,249 | 3/1980 | Thorneburg | 2/239 |

*Primary Examiner*—Ronald Feldbaum

*Attorney, Agent, or Firm*—Cushman, Darby & Cushman

[57] ABSTRACT

A method of knitting a stocking especially adapted for athletic use, and the stocking so produced. The stocking includes a top 3×1 mock-rib portion, with spandex being knit in every fourth wale, an ankle and instep portion, a heel portion and a toe portion. The ankle and instep portion has a 1×1 mock rib with spandex being knit in every other wale, and with terry loops having a first density formed on the interior of the ankle and instep portion. A heel portion is provided free of spandex and including terry loops of a second density greater than the first density, the second density being obtained by randomly introducing an auxiliary terry yarn through a different yarn finger than that through which the main terry yarn is introduced, in the heel portion. The toe portion is free of mock ribbing and has terry loops formed on the interior thereof having the first density.

16 Claims, 8 Drawing Figures

Fig. 5b
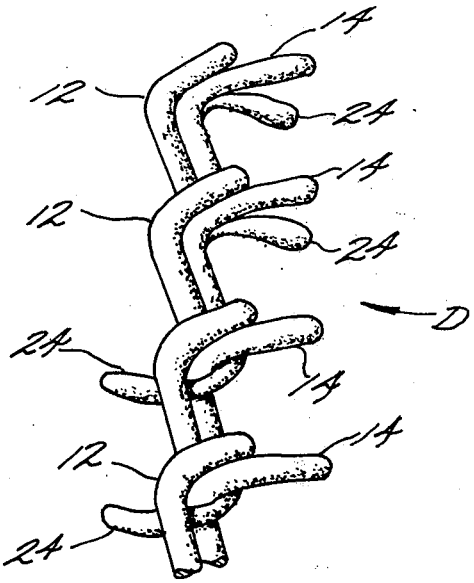
Fig. 7
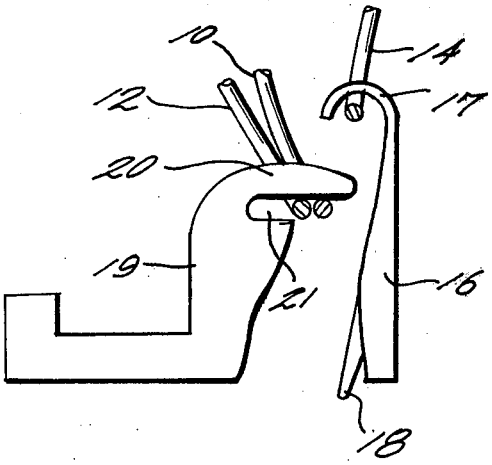
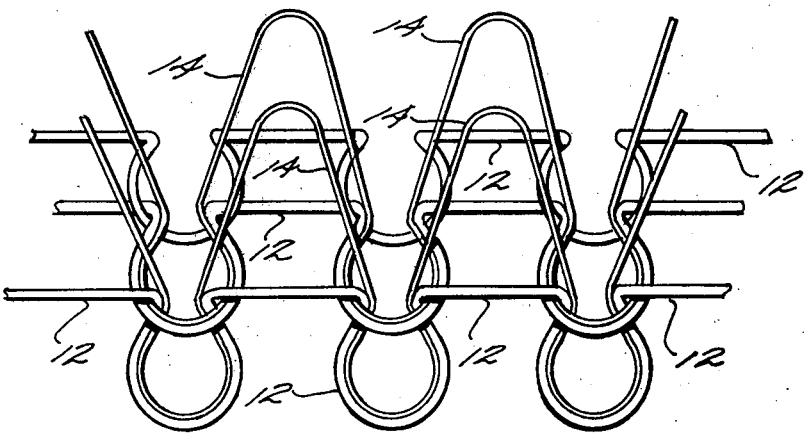
Fig. 6

SOCK CONSTRUCTION

BACKGROUND AND SUMMARY OF THE INVENTION

The invention relates to a method of constructing a stocking, and the stocking so constructed, especially adapted for running and jogging or other active sports where running is necessary in the participation of such sports. Conventional commercial sport socks (e.g., such as shown in U.S. Pat. No. 3,250,095) have terry loops of the same density formed over the entire interior thereof, with elastic yarn being provided with substantially uniform density throughout to urge the terry loops into contact with the skin of the wearer. While such socks are quite useful, they do not provide maximum cushioning for the foot areas that need cushioning. The sock according to the present invention contains additional cushioning at the heel thereof, which is especially important for sports requiring running, and additionally the sock according to the present invention has an ankle and instep portion with a 1×1 mock rib which provides excellent instep support. Additionally, the top portion of the stocking according to the present invention is a mock-rib portion, having a 3×1 mock rib which provides an aesthetically pleasing construction for sport socks.

The extra cushioning in the heel portion of the stocking according to the invention is provided by the random introduction of auxiliary yarn to provide said second loop density. There have been proposals in the past (e.g., see U.S. Pat. No. 3,793,851) to provide a built-up heel area to increase the size of the heel so that it fills a western boot, the built-up heel area being provided by plated auxiliary and main terry loops provided in the heel area. The extra cushioning provided according to the present invention does not take that approach, however, but rather the auxiliary terry yarn is run in a random manner through a different yarn finger than that through which the main terry yarn is introduced, with the auxiliary terry yarn being able to assume an orientation on the inside or outside of the stocking so that no plating is provided, but so that extra cushioning effect is provided at the heel portion. The toe portion of the stocking according to the present invention is free of mock ribbing, no spandex being provided therein, and terry loops are formed on the interior thereof, preferably with the same density as in the ankle and instep portion. The mock ribbing is formed in the ankle and instep portion by running the terry yarn in the hook of the knitting needle and over the neb of the sinker, and running backing yarn and spandex in the hook and under the neb.

It is the primary object of the present invention to provide an improved sock for running, jogging and sports requiring a good deal of running during participation therein. This and other objects of the invention will become clear from an inspection of the detailed description of the invention, and from the appended claims.

BRIEF DESCRIPTION OF THE DRAWINGS

FIG. 5*b* is an enlarged vertical sectional view of said heel portion;

FIG. 6 is an enlarged stitch diagram of the toe portion of the stockings of FIGS. 1 and 2; and FIG. 7 is a schematic view showing the feeding of yarn to an exemplary knitting needle during knitting of the ankle and instep portion of the stockings of FIGS. 1 and 2.

DETAILED DESCRIPTION OF THE DRAWINGS

Figure 1:
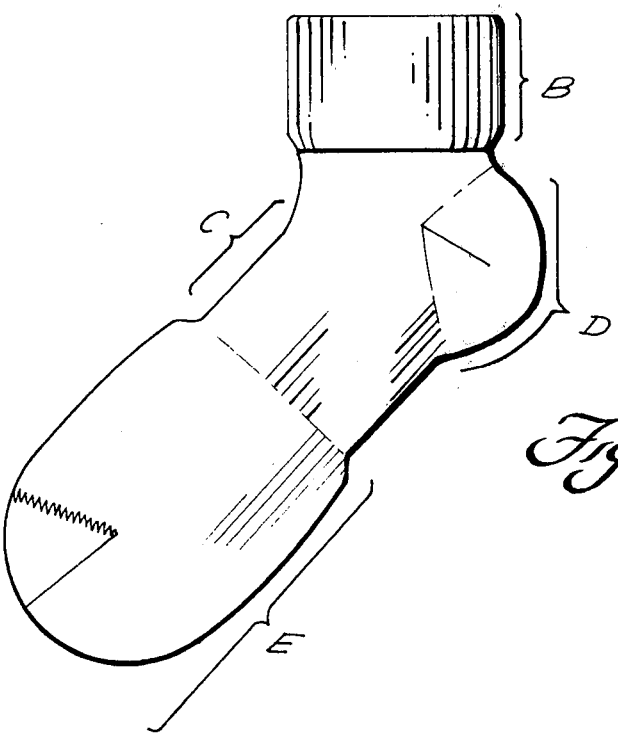
FIGS. 1 and 2 are side views of different embodiments of exemplary stockings according to the present invention.
Figure 2:
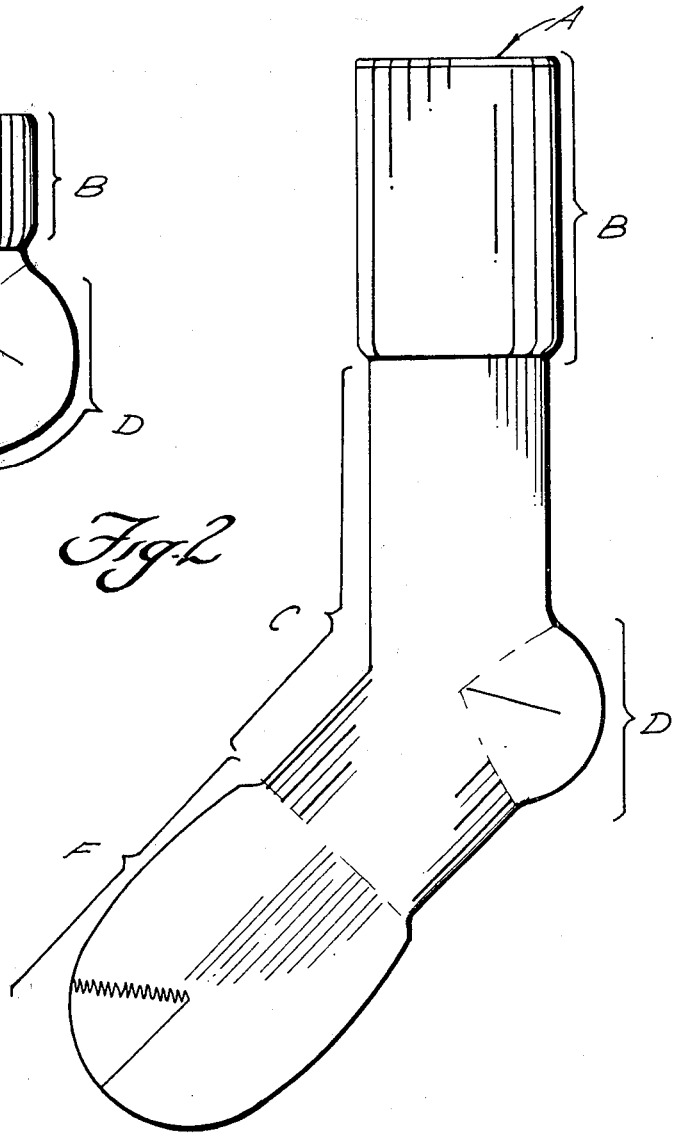

An exemplary sun sock according to the present invention is illustrated in FIG. 1, and an exemplary crew length stocking according to the present invention is illustrated in FIG. 2. Additionally, an over-the-calf embodiment of the stocking according to the present invention may also be provided. Whatever the exact type of stocking provided, the stocking according to the invention includes a welt portion A, a top portion B, an ankle and instep portion C, a heel portion D and a toe portion E.

The top portion B according to the present invention comprises a mock-rib portion having 2 x wales, wherein x is a positive integer. The welt portion A bordering the top portion at the top thereof preferably comprises a plurality of courses of spandex, the welt portion having x wales. The welt portion ensures that the top of the stocking will not roll, and one preferred way that this can be accomplished is by providing four courses of spandex. Other non-roll configurations can also be provided, such as shown in U.S. Pat. No. 4,109,492 (disclosure of which is hereby incorporated by reference herein).

Figure 3:
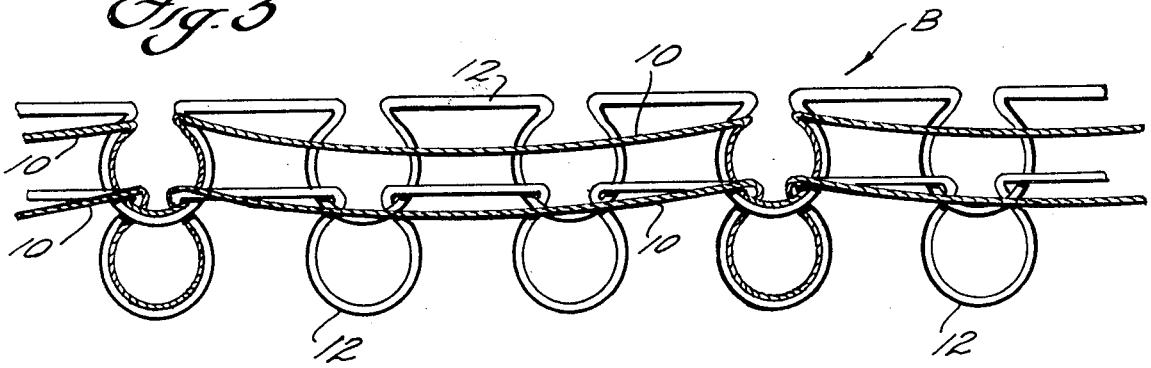
FIG. 3 is an enlarged stitch diagram showing the top portion of the stockings of FIGS. 1 and 2.

An exemplary stitch diagram for the top portion B is shown in FIG. 3, the mock rib being provided by spandex 10 being knitted in every fourth wale with the body yarn 12, a 3×1 mock rib thus being provided. As can be seen in FIG. 3, the top portion B is free of terry loops. Preferably, the spandex 10 is Lycra spandex, and the body yarn 12 is chosen from a variety of conventional body yarns, such as nylon. In the construction of a sun sock (FIG. 1), approximately 50 courses will be provided in the top portion B, with the top of the top portion being folded over and blind stitched to the bottom of the top portion inside the stocking, to thus provide a double top of 25 courses in length. In the formation of a crew stock (FIG. 2), preferably 60 courses are provided in the top portion B, and for an over-the-calf stocking approximately 134 courses would be provided in the top portion B.

Figure 4:
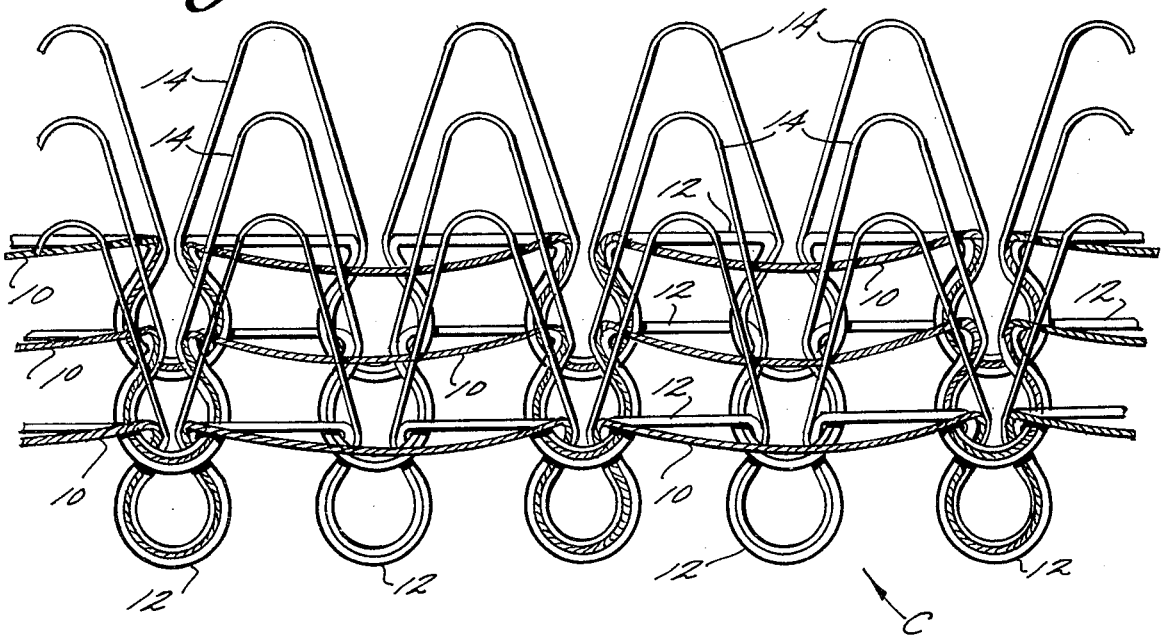
FIG. 4 is an enlarged stitch diagram showing the ankle and instep portions of the stockings of FIGS. 1 and 2.

The ankle and instep portion C is formed to provide additional compression and added support to that area of the foot of the wearer, and comprises a 1×1 mock rib with spandex 10 (see FIG. 4) being knit in every other wale with the body yarn 12, and with terry loops 14 (having a first density) formed on the interior of the ankle and instep portion C. The terry loops may be formed of any appropriate conventional yarn, such as orlon. The ankle and instep portion C is knitted on a conventional circular knitting machine including knitting needle 16 (see FIG. 7) having a hook portion 17 and a latch 18, and including sinkers 19 each having a neb 20 with a throat portion 21. To form the 1×1 mock rib, terry loop construction of FIG. 4, the terry yarn 14 is run in the hook 17 and over the neb 20, while the backing yarn 12 and and spandex 10 (every other needle for the spandex) are run in the hook 17 of the needle 16 and into the throat 21 of the sinker 19 under the neb 20.

Figure 5A:
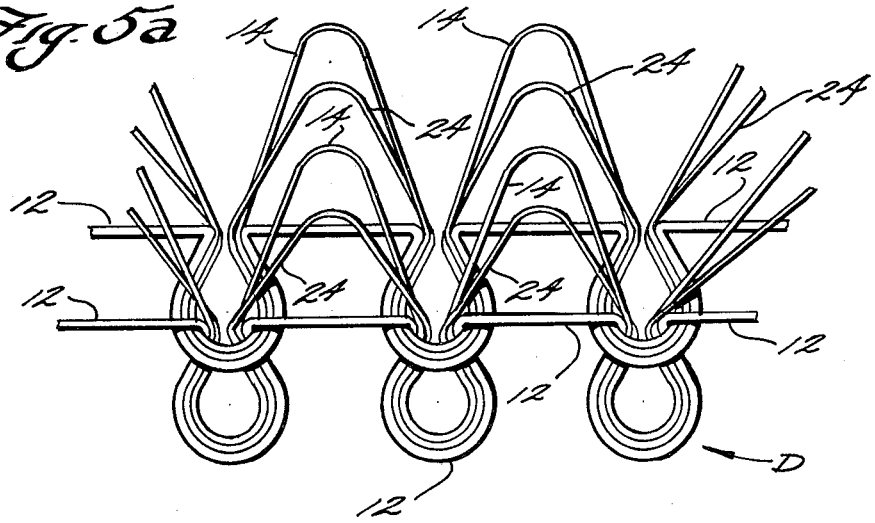
FIG. 5*a* is an enlarged stitch diagram of the heel portion of the stockings of FIGS. 1 and 2.

The heel portion D of the stocking is illustrated most clearly in FIGS. 5*a* and 5*b*. In the heel portion D, the spandex is dropped out, and an auxiliary terry yarn 24 is provided along with the main terry yarn 14 and the backing yarn 12. The auxiliary terry yarn 24 is not plated to the main terry yarn 14, but rather it is fed in through a separate yarn finger in a random manner. This random introduction manifests itself by the auxiliary yarn 24 assuming a position either inside the stocking (as illustrated in the top-most two courses in FIG. 5*b*), or outside the stocking (as illustrated in the bottom-most two courses in FIG. 5*b*). This random introduction provides a second terry loop density in the heel portion D which is greater than the first terry loop density provided in the ankle and instep portion C.

In the toe portion E (see FIG. 6 in particular), the spandex is dropped out and circular knitting is continued from the ankle and instep portion C utilizing the body yarn 12 and the terry loops 14. Thus, no mock ribbing is provided in the toe portion E. Preferably the terry loop density in the toe portion E is the same as in the ankle and instep portion C, the sock construction in the toe portion E thus being a conventional cushion foot sock construction in that area.

The method according to the present invention may be practiced on most conventional circular knitting machine having knitting needles, sinkers, and yarn fingers. The method thus comprises the steps of circular knitting a top mock-rib portion B, circular knitting an ankle and instep portion C having a 1×1 mock rib by knitting spandex in every other wale, and forming terry loops 14, having a first density, on the interior of the ankle and instep portion; knitting a heel portion including terry loops 14, 24 having a second density greater than the first density; and circular knitting a toe portion E free of mock ribbing and including terry loops 14 formed on the interior thereof.

It will thus be seen that according to the present invention a stocking has been provided which is essentially adapted for use in athletics requiring significant amounts of running, and a method has been provided for simply constructing such a sock. While the invention has been herein shown and described in what is presently conceived to be a practical and preferred embodiment thereof, it will be apparent to those of ordinary skill in the art that modifications may be made thereof within the scope of the invention, which scope is to be accorded the broadest interpretation of the appended claims so as to encompass all equivalent structures and methods.

What is claimed is:

1. A stocking comprising a top portion comprising a mock-rib portion and having 2 x wales, wherein x is a positive integer;

an ankle and instep portion having a 1×1 mock rib with spandex being knit in every other wale to provide instep support and with terry loops having a first density formed on the interior of the ankle and instep portion;

a heel portion comprising terry loops of a second density, greater than said first density; and a toe portion free of mock ribbing and having terry loops formed on the interior thereof.

2. A stocking as recited in claim 1 wherein said heel portion further comprises randomly introduced auxiliary yarn provided as auxiliary terry loops, said auxiliary terry loops providing said second loop density.

3. A stocking as recited in claims 1 or 2 wherein said mock-ribbed top portion has a 3×1 mock rib with spandex being knit in every fourth wale, said top portion being free of terry loops.

4. A stocking as recited in claims 1 or 2 wherein said heel portion is free of spandex, and wherein said toe portion terry loops have said first density.

5. A stocking as recited in claims 1 or 2 wherein said top portion is formed as a folded over portion with the top thereof stitched to the bottom thereof inside the stocking.

6. A stocking as recited in claims 1 or 2 further comprising a welt portion bordering said top portion at the top thereof comprising a plurality of courses of spandex, said welt portion having x wales.

7. A method of making a stocking comprising the steps of (a) circular knitting a top mock-rib portion;

(b) circular knitting an ankle and instep portion having a 1×1 mock rib by knitting spandex in every other wale to provide instep support, and forming terry loops, having a first density, on the interior of the ankle and instep portion;

(c) knitting a heel portion including terry loops having a second density, greater than said first density; and (d) circular knitting a toe portion free of mock ribbing and including terry loops formed on the interior thereof.

8. A method of recited in claim 7 wherein step (b) is accomplished by knitting on a circular knitting machine including knitting needles having a hook portion, and sinkers having a neb, and wherein said mock rib is obtained by running the terry yarn in the hook and over the neb and running backing yarn in the hook and under the neb, the spandex being introduced with the backing yarn in every other needle.

9. A method as recited in claim 7 wherein step (c) is accomplished by utilizing a circular knitting machine having yarn fingers for feeding yarn to the knitting needles, and wherein said second density in said heel portion is obtained by running an auxiliary terry yarn in a random manner through a separate yarn finger as the yarn finger through which the terry yarn is introduced, the auxiliary terry yarn being able to assume an orientation on the inside or outside of the stocking.

10. A method as recited in claim 9 comprising the further step of terminating feeding of spandex during step (c) so that the heel portion is free of spandex.

11. A method as recited in claim 7 wherein step (a) is practiced to form a 3×1 mock rib without terry loops.

12. A method of making a stocking utilizing a knitting machine having yarn fingers for feeding yarn to the knitting needles, and comprising the steps of (a) circular knitting a top portion;

(b) circular knitting an ankle and instep portion having terry loops of a first density formed on the stocking interior from a main terry yarn;

(c) knitting a heel portion having a second density of terry loops, greater than the first density, by running an auxiliary terry yarn in a random manner through a separate yarn finger as the yarn finger through which the main terry yarn is introduced, the auxiliary terry yarn being able to assume an orientation on the inside or outside of the stocking; and (d) circular knitting a toe portion having terry loops formed on the stocking interior.

13. A method as recited in claim 12 wherein said toe portion has terry loops having the first density.

14. A method as recited in claim 12 wherein step (a) is accomplished by forming a mock-rib top portion.

15. A method as recited in claim 12 utilizing a circular knitting machine having knitting needles with a hook portion, and sinkers with a neb, and wherein step (b) is accomplished by knitting a 1×1 mock rib ankle and instep portion having spandex knit in every other wale by running the terry yarn in the hook and over the neb and running a backing yarn in the hook and under the neb, the spandex being introduced with the backing yarn in every other needle.

16. A method of making a stocking, utilizing a circular knitting machine having knitting needles with a hook portion, and sinkers with a neb, and comprising the steps of (a) circular knitting a top stocking portion;

(b) circular knitting a 1×1 mock rib ankle and instep portion having interior terry loops formed from a terry yarn, and spandex in every other wale, by running the terry yarn in the hook and over the neb and running a backing yarn in the hook and under the neb, the spandex being introduced with the backing yarn in every other needle;

(c) knitting a heel portion having terry loops; and (d) circular knitting a toe portion free of mock ribbing and having interior terry loops.

* * * * *